United States Patent [19]

Yamamoto et al.

[11] Patent Number: 4,801,933

[45] Date of Patent: Jan. 31, 1989

[54] LIQUID CRYSTAL MATRIX DEVICE HAVING SEPARATE DRIVING CIRCUITS WITH DIVERSE DRIVING VOLTAGES

[75] Inventors: Kunihiko Yamamoto; Yutaka Ishii, both of Nara; Hiroshi Take, Ikoma, all of Japan

[73] Assignee: Sharp Kabushiki Kaisha, Osaka, Japan

[21] Appl. No.: 841,798

[22] Filed: Mar. 20, 1986

[30] Foreign Application Priority Data

Mar. 23, 1985 [JP] Japan ..... 60-59002

[51] Int. Cl.[4] ..... G09G 3/36

[52] U.S. Cl. ..... 340/784; 340/702; 340/765; 350/332

[58] Field of Search ..... 340/765, 784, 703, 701, 340/702; 350/332, 339 F

[56] References Cited

U.S. PATENT DOCUMENTS

| | | | |
|---|---|---|---|
| 4,317,115 | 2/1982 | Kawakami et al. | 340/784 |
| 4,395,709 | 7/1983 | Nagae et al. | 340/784 |
| 4,574,280 | 3/1986 | Weber | 340/718 |
| 4,593,978 | 6/1986 | Mourey et al. | 340/784 |
| 4,642,628 | 2/1987 | Murata | 340/784 |
| 4,646,074 | 2/1987 | Hashimoto | 340/784 |

FOREIGN PATENT DOCUMENTS

| | | |
|---|---|---|
| 0158366 | 10/1985 | European Pat. Off. . |
| 0167408 | 1/1986 | European Pat. Off. . |
| 0177247 | 4/1986 | European Pat. Off. . |
| 2521059 | 5/1975 | Fed. Rep. of Germany . |
| 2620530 | 5/1976 | Fed. Rep. of Germany . |
| 2846874 | 10/1978 | Fed. Rep. of Germany . |
| 3107827 | 2/1981 | Fed. Rep. of Germany . |
| 3313804 | 4/1983 | Fed. Rep. of Germany . |
| 3437361 | 10/1984 | Fed. Rep. of Germany . |
| 2180979 | 4/1987 | United Kingdom . |

OTHER PUBLICATIONS

"Eurodisplay '81", Proceedings of the First European Display Research Conference, Sep. 16–18, 1981, pp. 39–42.

*Primary Examiner*—Gerald L. Brigance
*Assistant Examiner*—Jeffery A. Brier
*Attorney, Agent, or Firm*—Birch, Stewart, Kolasch & Birch

[57] ABSTRACT

A multiplex-driven liquid crystal X-Y matrix display in which the electrodes are divided into several blocks and a driving voltage is independently applied to each of the blocks. Each driving voltage has a magnitude that is different from the remaining drive voltages. The display panel is free from nonuniform or deteriorated contrast even if it has a large number of scanning electrodes. Besides, for a color display, the color balance is favorably adjusted, realizing a high quality picture image.

6 Claims, 5 Drawing Sheets

LIQUID CRYSTAL MATRIX DEVICE HAVING SEPARATE DRIVING CIRCUITS WITH DIVERSE DRIVING VOLTAGES

BACKGROUND OF THE INVENTION

1. Field of the Invention

The present invention relates to a liquid crystal display or more specifically to a multiplex-driven liquid crystal matrix display.

2. Description of the Prior Art

Due to the recent increasing demand for a liquid crystal display with larger display information capacity, the industry's attention is gradually moving from a segment display to a matrix display. For diversification of the information displayed on an matrix display, the increase in the matrix-driving multiplex frequency (the number of scanning electrodes) is demanded.

A transmission type liquid crystal display (TN-LCD) which incorporates color filters or color polarizers for colored display is increasingly drawing attention. To realize a liquid crystal color television with this display system, investigation into the drive method, color filter construction and suitable liquid crystal material has been conducted in various sectors of the industry. The primary challenge for this display system is to produce colors of high purity and wide range of hues. However, study in this field has not been sufficient so far.

When a liquid crystal X-Y matrix display panel is driven by the optimal voltage averaging method with a multiplex frequency of N, it has been well-known that the maximum contrast ratio is obtained when there exists the relationship as expressed by the following equation (1), between the scanning pulse peak voltage $V_1$ and the signal pulse peak voltage $V_2$.

$$V_1=\sqrt{N}V_2 \quad (1)$$

In this case, the ratio $\alpha$ of the effective voltage for lighted-on picture elements, $V_{ON}$, to that for the lighted-off picture elements, $V_{OFF}$, is expressed by the equation:

$$\alpha = \frac{V_{ON}}{V_{OFF}} = \sqrt{\frac{\sqrt{N}+1}{\sqrt{N}-1}} \quad (2)$$

It is clear from the above formula that the difference between $V_{ON}$ and $V_{OFF}$ reduces as the number of scanning electrodes N increases.

Assuming that N is 200, for instance, the voltage applied to the lighted-on picture elements is only 7.3% higher than that applied to the lighted-off picture elements. When N is larger, the voltage drops due to the electrode resistance, and the threshold voltage for the electric optical properties such as lighting-on and -off of the display panel-constituting liquid crystal fluctuates, causing less uniform or poorer contrast of a picture of the liquid crystal display panel. Accordingly, the number of scanning electrodes N cannot be increased without deteriorating the picture contrast.

Moreover, in the multiplex-driven colored display, dependence of the transmitted light intensity upon the voltage applied to the liquid crystals varies with the color (light wavelength) of the transmitted light. Even if other properties of the display panel-constituting liquid crystals are uniform, therefore, it is difficult to achieve a good color balance.

OBJECTS AND SUMMARY OF THE INVENTION

Objects of the Invention

In view of the foregoing, it is the object of the present invention to provide a liquid crystal matrix display in which an increase in the multiplex frequency (the number of scanning electrodes) does not cause a picture with irregular or poor contrast on the liquid crystal panel, and which has a good color balance for colored display. Other objects and further scope of applicability of the present invention will become apparent from the detailed description given hereinafter. It should be understood, however, that the detailed description and specific examples, while indicating preferred embodiments of the invention, are given by way of illustration only; various changes and modifications within the spirit and scope of the invention will become apparent to those skilled in the art from this detailed description.

SUMMARY OF THE INVENTION

A liquid crystal matrix display of an embodiment of the present invention comprises a matrix composed of a plurality of signal electrodes arranged in one direction and a plurality of scanning electrodes arranged in an orthogonal direction, the plurality of signal electrodes and/or scanning electrodes being divided into a plurality of blocks; and multiplex driving circuits each connected to each of the plurality of blocks to supply independently controllable voltages to the corresponding blocks.

When a colored picture is to be presented on the liquid crystal matrix display, the plurality of signal electrodes are identified by a plurality of different colors and divided into the blocks by color. The colors for the signal electrodes are preferably red, green and blue.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
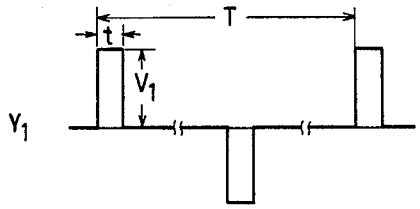
FIGS. 1(A) through 1(E) are waveform charts showing applied voltages, for explaining an operational mode of a liquid crystal matrix display panel of the present invention.
Figure 1:
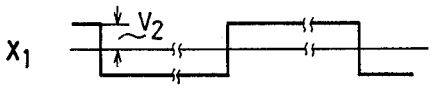
Figure 1:
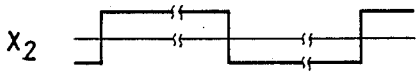
Figure 1:
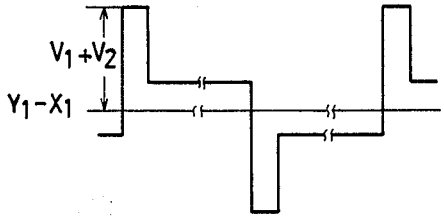
Figure 1:
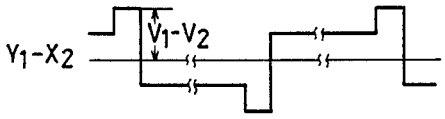

The principle of the present invention is first described with reference to the drawings. FIGS. 1(A) through 1(E) show examples of the applied voltages determined by the voltage averaging method, in a liquid crystal X-Y matrix display panel. FIG. 1(A) shows the waveform of a voltage applied to a scanning electrode $Y_1$, FIGS. 1(B) and 1(C) show the waveforms of voltages applied to signal electrodes $X_1$ and $X_2$ respectively, FIG. 1(D) shows the waveform of a voltage applied to lighted-on picture elements, and FIG. 1(E) shows the waveform of a voltage applied to lighted-off picture elements. t is the ON period for one scanning electrode, T is a frame cycle, $V_1$ is the peak voltage applied to the scanning electrodes, and $V_2$ is the peak voltage applied to the signal electrodes.

As mentioned earlier, a liquid crystal X-Y matrix display panel provides a maximum contrast ratio when the voltages $V_1$ and $V_2$ have the relationship as expressed by the equation (1), and in this case, the ratio $\alpha$ of the voltage applied to lighted-on picture elements to that applied to the lighted-off picture elements is obtained by the equation (2).

Here, assuming that the voltages $V_1$ and $V_2$ do not have the above relationship but have the relationship expressed as:

$$\frac{V_1}{\sqrt{N}\,V^2} = k \tag{3}$$

then, the ratio $\alpha$is, as is well-known, expressed by the equation:

$$\alpha = \frac{V_{ON}}{V_{OFF}} = \left[\frac{(k\sqrt{N}+1)^2+(N-1)}{(k\sqrt{N}-1)^2+(N-1)}\right]^{\frac{1}{2}} \tag{4}$$

Figure 2:
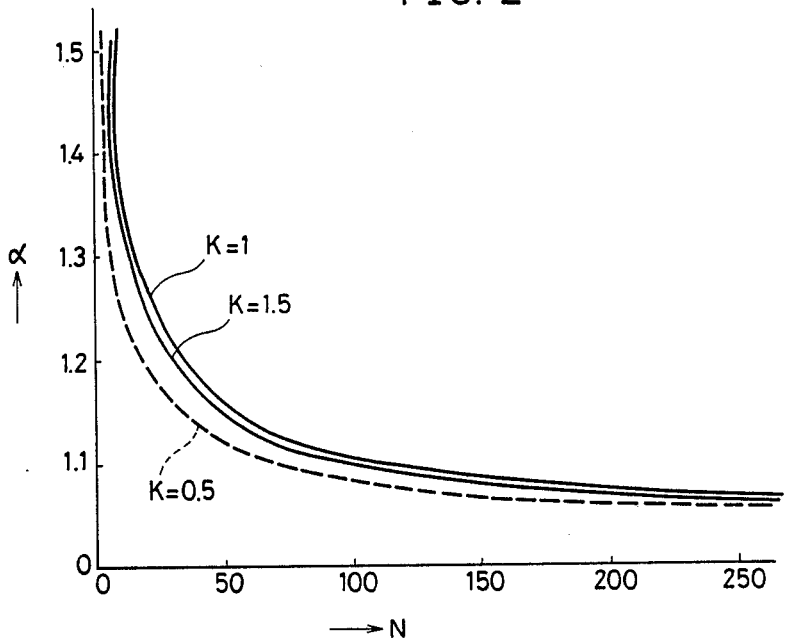
FIG. 2 is a graph for explaining the principle of the present invention.

As shown in FIG. 2 which graphically indicates the relationship expressed by the equation (4), the ratio $\alpha$ changes only a little with ±50% fluctuation of K, if N is large.

Meanwhile, the voltage $V_{ON}$ applied to lighted-on picture elements is expressed by the equation:

$$V_{ON} = \left\{\frac{1}{N}(V_1+V_2)^2 + \frac{(N-1)}{N}V_2^2\right\}^{\frac{1}{2}} \tag{5}$$

As understood from this equation, $V_{ON}$ varies depending upon the voltages $V_1$ and $V_2$.

Figure 3:
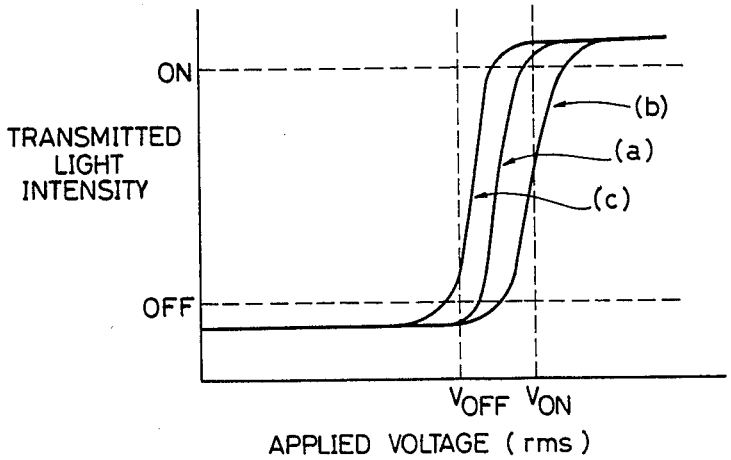
FIG. 3 is a graph showing the relationship between the applied voltage and the transmitted light intensity.

FIG. 3 shows the relationship between the applied voltage and the transmitted light intensity of liquid crystals. The liquid crystal (a) is accurately lit ON and OFF with the applied voltages $V_{ON}$ and $V_{OFF}$ respectively, whereas the liquid crystals (b) and (c) are not lit ON and OFF properly because of the discrepancy between the liquid crystal property and the appropriate applied voltage. Accordingly, if a panel is composed of liquid crystals with different properties, nonuniform contrast will result.

To accommodate for such various liquid crystal properties, the voltages $V_1$ and $V_2$ in the equation (5) are controlled so as to adjust the voltage $V_{ON}$ suitably. Then, since the ratio $\alpha$ shows minor variation at a large N value, the voltage $V_{OFF}$ is correspondingly adjusted. As a result, even liquid crystals with various properties as identified by (b) and (c) in FIG. 3 can be driven properly. As described above, when the value N is large, the voltages $V_{ON}$ and $V_{OFF}$ can be adjusted by controlling the voltages $V_1$ and $V_2$ without causing substantial change in the ratio $\alpha$. The principle of the present invention is to accommodate for the various properties of the liquid crystals by adjusting the voltages $V_{ON}$ and $V_{OFF}$ appropriately, making use of the above feature.

Figure 4:
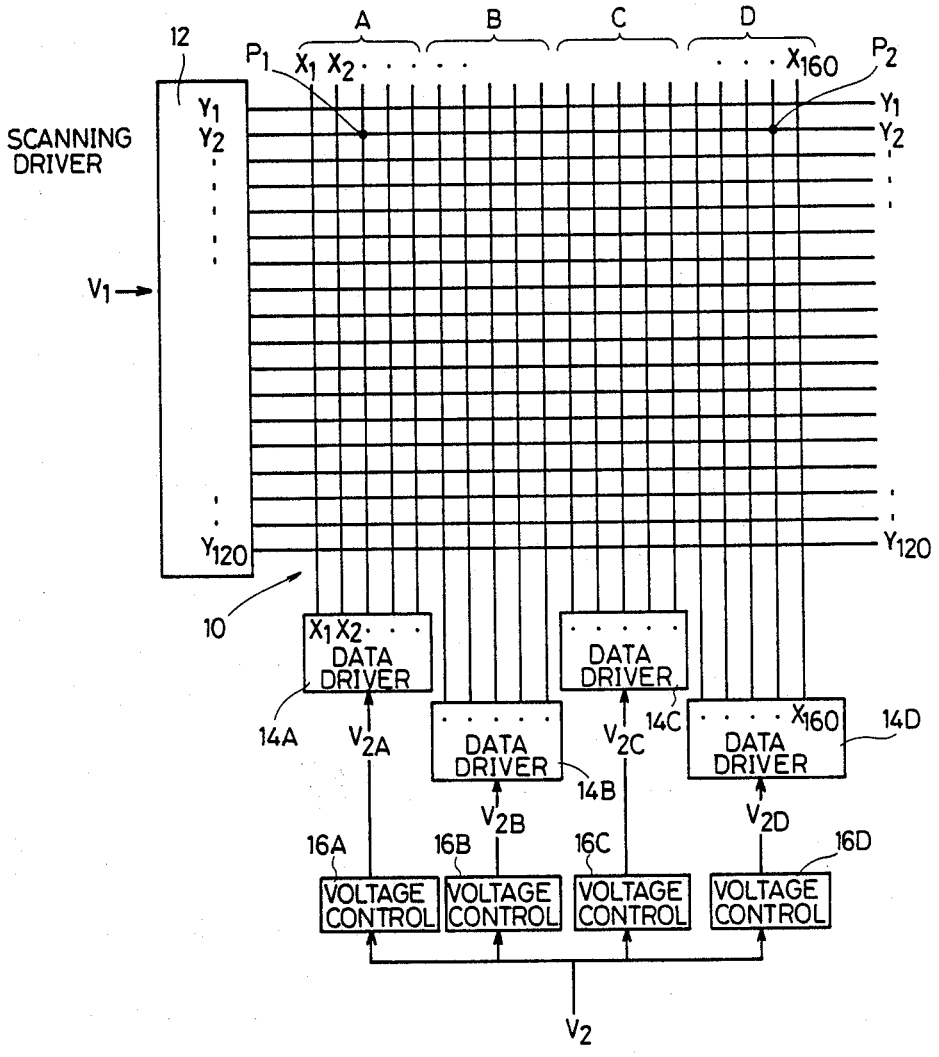
FIG. 4 is an electric circuit diagram of an embodiment of the present invention.

FIG. 4 shows the circuit diagram of a liquid crystal matrix display of an embodiment of the present invention. A liquid crystal X-Y matrix display panel 10 comprises 160 X-electrodes (signal electrodes) $X_1$ through $X_{160}$ and 120 Y-electrodes (scanning electrodes) $Y_1$ through $Y_{120}$. A scanning driver 12 supplies scanning voltage $V_1$ to the Y-electrodes $Y_1$ through $Y_{120}$. The X-electrodes $X_1$ through $X_{160}$ are divided equally into four blocks A, B, C and D. Data drivers 14A, 14B, 14C and 14D are connected to the blocks A, B, C and D, respectively, to independently supply signal voltages $V_{2A}$, $V_{2B}$, $V_{2C}$ and $V_{2D}$ to the X-electrodes in the blocks A, B, C and D, respectively. The data drivers 14A, 14B, and 14C and 14D are connected with voltage controls 16A, 16B, 16C and 16D, respectively, which control the signal voltage $V_2$ to output the signal voltages $V_{2A}$, $V_{2B}$, $V_{2C}$ and $V_{2D}$, respectively. PCH liquid crystals are used in this embodiment. In FIG. 4, the X-electrodes $X_1$ through $X_{160}$ have a resistance of 10kΩ and the Y-electrodes $Y_1$ through $Y_{120}$ have a resistance of 70kΩ. The display panel 10 is first driven by applying the scanning voltage $V_1$ and signal voltage $V_2$ with waveforms of 1/120 duty ratio and of 60 Hz frame frequency obtained by the voltage averaging method, as shown in FIGS. 1(A) and 1(E), to the scanning driver 12 and to the data drivers 14A, 14B, 14C and 14D, respectively.

Figure 5A:
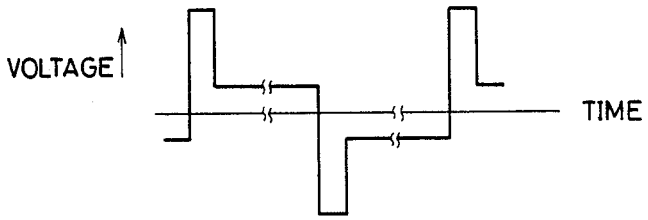
FIGS. 5(A) and 5(B) are charts for explaining the applied voltage in the embodiment of FIG. 4.
Figure 5:
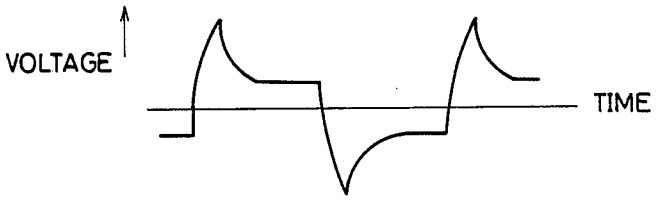

When $V_2=V_{2A}=V_{2B}=V_{2C}=V_{2D}$, the contrast deteriorated gradually from the point $P_1$ toward the point $P_2$ on the panel (10). This is because the liquid crystal electrostatic capacitance causes a time lag in the applied voltage at a higher electrode resistance, so that the applied voltage shown in FIG. 5(A) is changed into the one shown in FIG. 5(B). More specifically, the more remote the liquid crystals are away from the voltage signal input terminal, the smaller effective voltages $V_{ON}$ and $V_{OFF}$ are applied to the liquid crystals, resulting in improperly driven liquid crystals. When the voltage signal inputs to the data drivers 14A, 14B, 14C and 14D are controlled to become $V_2=V_{2A}<V_{2B}<V_{2C}<V_{2D}$, the nonuniform contrast is corrected so that a picture image with regular and substantially uniform contrast is obtained over the entire panel 10. When high resistance electrodes are used for the X-electrodes, it is also possible to adjust the contrast by dividing the Y-electrodes $Y_1$ through $Y_{120}$ into a plurality of blocks and controlling the scanning voltage $V_1$ for each block in the same manner as in controlling the signal voltage $V_2$.

Figure 6:
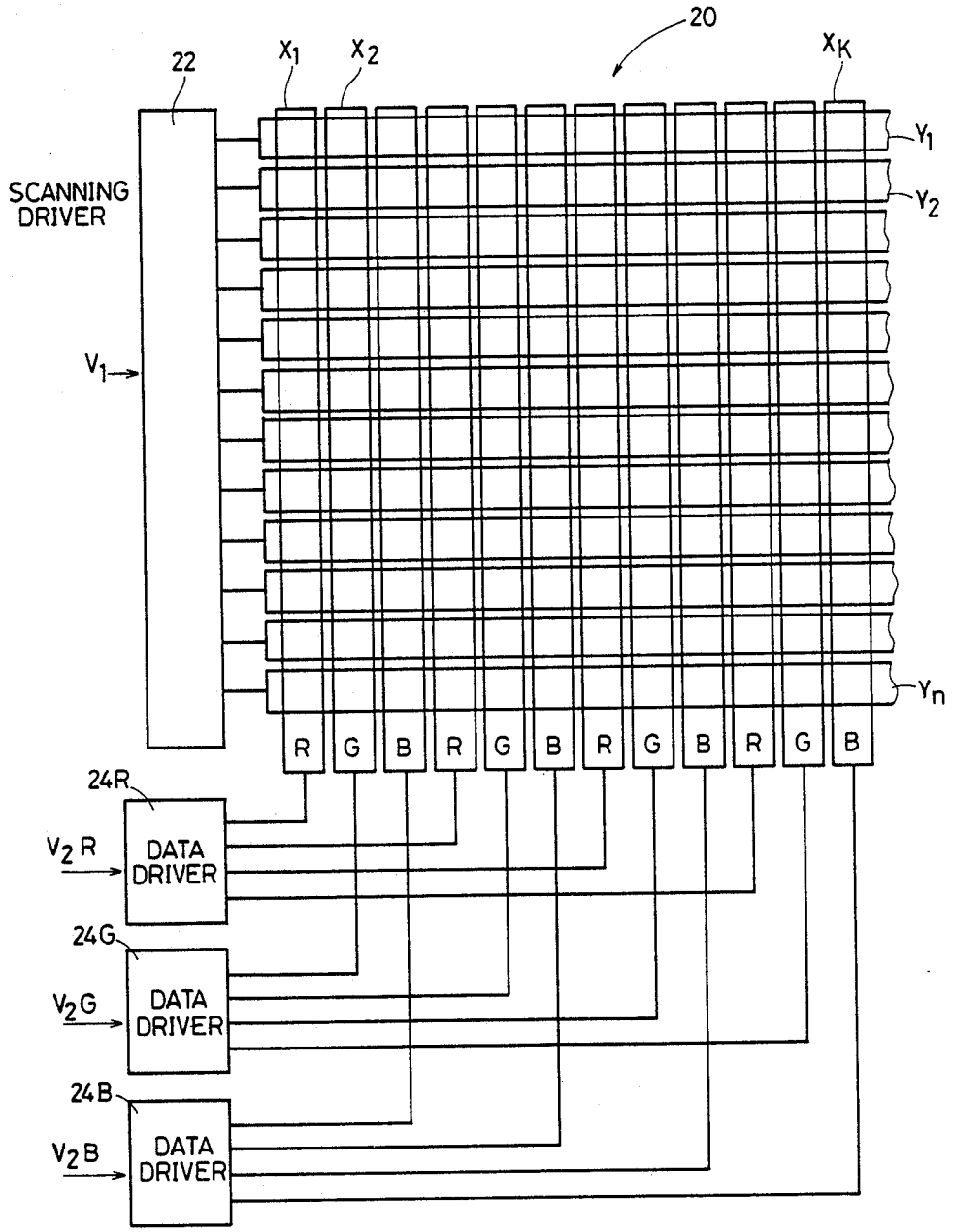
FIG. 6 is an electric circuit diagram of another embodiment of the present invention.

FIG. 6 shows the electrical circuit diagram of a liquid crystal matrix display of another embodiment of the present invention. A color liquid crystal X-Y matrix display panel 20 comprises X-electrodes (signal electrodes) $X_1$ through $X_k$ and Y-electrodes (scanning electrodes) $Y_1$ through $Y_n$. The X-electrodes (signal electrodes) $X_1$ through $X_k$ are colored red (R), green (G) or blue (B) by filters. A scanning driver 22 is connected to the Y electrodes (scanning electrodes) $Y_1$ through $Y_n$ to supply a scanning voltage $V_1$ to the Y-electrodes (scanning electrodes) $Y_1$ through $Y_n$. A red data driver 24R is connected commonly to the red X-electrodes (R) to supply a signal voltage $V_{2R}$ thereto, a green data driver 24G to the green X-electrodes (G) to supply a signal voltage $V_{2G}$, and a blue data driver 24B to the blue X-electrodes (B) to supply a signal voltage $V_{2B}$.

Figure 7:
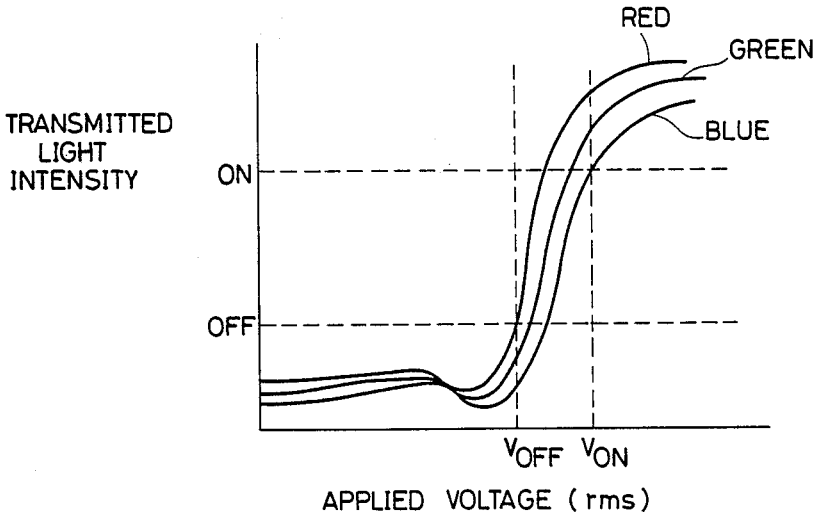
FIG. 7 is a graph showing the transmitted light intensity for each color.

The transmitted light intensity of each colored liquid crystal depends upon the applied voltage to various extents depending on the color. As indicated in FIG. 7, for example, the dependence of the transmitted light intensity on the applied voltage is larger in the order of blue, green and red. It is therefore impossible to synthesize, for example, black or white with the same applied voltage. If the signal voltages $V_{2R}$, $V_{2G}$ and $V_{2B}$, are supplied through the respective data drivers 24R, 24G and 24B to the X-electrodes divided by color into blocks, and controlled to become $V_{2R}<V_{2G}<V_{2B}$, the applied voltages ($V_{ON}$, $V_{OFF}$) which govern the transmitted light intensities for different colors are adjusted so that the transmitted light intensities of the different colors for a given applied voltage ($V_{ON}$, $V_{OFF}$) coincide with one another. Consequently, it becomes possible to synthesize white or black color and produce well-balanced neutral tints.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A liquid crystal matrix display device, comprising:

a plurality of signal electrodes arranged in a first direction, and divided into a plurality of electrode blocks;

a plurality of scanning electrodes arranged in a second direction perpendicular to said first direction, intersections of said signal and scanning electrodes forming picture elements of said display; and a plurality of driver circuits for driving said signal electrodes, each driver circuit being connected to a block of signal electrodes, each of said plurality of driver circuits applying a driving voltage to a respective block, each driving voltage having a magnitude that is different from the remaining driving voltages.

2. The liquid crystal matrix display device defined in claim 1, wherein said electrode blocks are formed of groups of adjacent signal electrodes.

3. The liquid crystal matrix display device defined in claim 1, wherein said signal electrodes comprise a plurality of electrodes of different colors, each said electrode block being formed of a group of signal electrodes of one of said colors.

4. The liquid crystal matrix display device defined in claim 3, wherein said colors are red, green and blue.

5. The liquid crystal matrix display device defined in claim 1, wherein said scanning electrodes are divided into a plurality of scanning electrode blocks, said device further comprising:

a plurality of scanning driver circuits for driving said scanning electrode blocks, each scanning driver circuit applying a scanning voltage to a respective scanning electrode block, each scanning voltage having a magnitude that is different from the remaining scanning voltages.

6. A liquid crystal matrix display device, comprising:

a plurality of scanning electrodes arranged in a first direction, and divided into a plurality of electrode blocks;

a plurality of signal electrodes arranged in a second direction perpendicular to said first direction, intersections of said scanning and signal electrodes forming picture elements of said display; and a plurality of driver circuits for driving said scanning electrodes, each driver circuit being connected to a block of scanning electrodes, each of said plurality of driver circuits applying a driving voltage to a respective block, each driving voltage having a magnitude that is different from the remaining driving voltages.

* * * * *